US007465058B1

(12) United States Patent
Lopez

(10) Patent No.: US 7,465,058 B1
(45) Date of Patent: Dec. 16, 2008

(54) BOTTLE STORING CONTAINER AND LAMP COMBINATION

(76) Inventor: Carlos A. Lopez, 1201 Brickell Ave., Suite 620, Miami, FL (US) 33131

( * ) Notice: Subject to any disclaimer, the term of this patent is extended or adjusted under 35 U.S.C. 154(b) by 0 days.

(21) Appl. No.: 11/899,495

(22) Filed: Sep. 5, 2007

(51) Int. Cl.
*F21V 33/00* (2006.01)

(52) U.S. Cl. ..... 362/154; 362/101; 362/234

(58) Field of Classification Search ..... 362/96, 362/101, 154, 234, 240, 253, 362, 812; 220/4.21, 220/4.22, 4.23, 4.24, 509
See application file for complete search history.

(56) References Cited

U.S. PATENT DOCUMENTS 1,157,008 A * 10/1915 Lang ..... 220/4.22
6,020,823 A * 2/2000 DeCicco ..... 220/DIG. 16
6,732,880 B1 * 5/2004 Nash, Sr. ..... 220/4.22
2005/0007773 A1 * 1/2005 Austin ..... 362/101

* cited by examiner

*Primary Examiner*—Y My Quach Lee
(74) *Attorney, Agent, or Firm*—Alberto A. Leon; Bauman, Dow & Leon

(57) ABSTRACT

The present invention is multifunction device which can be used as a bottle storing container, an advertisement tool and a lighting device. The invention comprises a cylindrical metal container of appropriate length and diameter to store a liquor bottle, and it also provides means to place a logo or other advertisement tool on its outer surface. The invention also provides lighting means and a perforation configuration to project light which adopts the color of the bottle and the shape of the perforations. The combination of color and shape of the projected light, in and of itself, can also represent an advertisement tool for a particular kind of beverage.

6 Claims, 4 Drawing Sheets

BOTTLE STORING CONTAINER AND LAMP COMBINATION

BACKGROUND OF THE INVENTION

1. Technical Field of the Invention

This invention relates generally to storing devices and illumination devices, more particularly, but not by way of limitation, to a bottle storing case which features a decorative and promotional lamp.

2. Description of the Background Art

Traditionally, liquor bottles have been an integral part of the products advertisement. In fact, the color and shape of the bottle and other external characteristics of liquor containers have become famous and valuable trademarks through the acquisition of secondary meaning. Most liquor dispensing establishments display the liquor bottles prominently as a way to catch the potential customers' attention. It is also common for bars to have light emanating promotional devices, such as neon signs conspicuously displaying a liquor's name, logo or other trademark-type characteristic.

Advertisement devices displaying well known liquor trademarks are also commonly used decorative tools in many US households. Often, people who have wet bars at their house decorate them to look like a commercial liquor dispensing establishment. To that end, they use the same type of bottle displays and neon signs commonly found in bars. Accordingly, illumination devices displaying liquor logos are well known in the art. Further, bottle lamps or lanterns are also commonly found in the prior art. For example, U.S. Pat. No. 6,086,216 to Goldfarb discloses and claims a portable lighting device which uses a bottle as the light transmitting element of a lamp. Other devices where a light source is combined with a bottle to result in a bottle lamp have been patented, notably the device disclosed and claimed in U.S. Pat. No. 5,012,393 to Knipe. Further, there are known kits or conversion units to incorporate a bottle into a lamp as disclosed and claimed in U.S. Pat. No. 4,325,109 to Mwanyoha.

SUMMARY OF THE INVENTION

An objective of the present invention is to provide for a visually appealing and easy to use bottle storage container which can also serve as an illumination device.

Another objective of the present invention is to utilize the bottle container and lamp combination of the invention to project light tinted with the bottle's color and various predetermined shapes and images determined by perforations on the container.

Still another objective of the present invention is to provide for a visually attractive advertising tool which can include the logo of a particular brand of beverage printed on the exterior of the bottle container and light of the characteristic color of the liquor bottle.

The bottle container lamp combination of the present invention comprises a housing capable of being opened along its longitudinal axis and shaped so it is capable of storing a bottle upon snap-closing, the housing in turn comprises perforations which allow light generated inside the housing to project in various pre-determined shapes and an outside surface capable of receiving a logo or any other advertisement. The housing comprises a longitudinal hinge system located directly opposite to the section of the housing which opens to receive a bottle, the hinge system being capable of allowing the housing to be opened to receive a bottle and of holding a power cord when the housing is in the closed position. The bottle container also comprises a top lid and a bottom lid. The top lid comprises a circuit board firmly attached to the inside of the lid and wire connections capable of connecting to a source of power via a power cord through a plug and an on/off switch on the exterior side of the lid, and a top hub firmly attached to the bottom of the top lid forming an enclosure which houses the circuit board and the wires, the top hub being appropriately shaped to hold the top of a bottle firmly in place, the top hub housing multiple LED bulbs connected to the power source through the wire connectors capable of illuminating the inside of the bottle container so that the light reflects against the bottle and projects outwardly through the perforations upon turning the exterior switch on, the top hub further comprising a plug capable of receiving a power cord. The bottom lid comprises a bottom hub firmly attached to the bottom side of the bottom lid shaped so it can receive a power cord rolled around the bottom hub and at the same time hold the bottom of a bottle firmly in place.

An alternative embodiment of the invention would comprise a combination of perforations in a particular shape, a color bottle and a logo printed on the housing which would clearly denote particular brand of beverage. Still another alternative embodiment of the invention would comprise a housing shaped in the recognizable shape of a particular beverage bottle.

The device of the present invention can be used as a decorative or advertisement tool, or both. Although the invention disclosed herein can be adapted to almost any usable size and bottle shape, and the resulting container/lamp combination can be built of almost any suitable material, including wood, metal and plastic, and can project light in any conceivable shape or color through the use of colored LED bulbs or colored bottles.

Further, the apparatus disclosed and claimed herein is not limited to the exact details shown in the drawings, since equivalents and colorable imitations thereof will be evident to a person of ordinary skill in the art. Thus, the invention may be practiced otherwise than as specifically shown and described herein.

BRIEF DESCRIPTION OF THE DRAWINGS

FIG. 2 is a perspective view of the assembled invention closed, containing a bottle and with the lights turned on.

PREFERRED EMBODIMENT OF THE INVENTION

Figure 1:
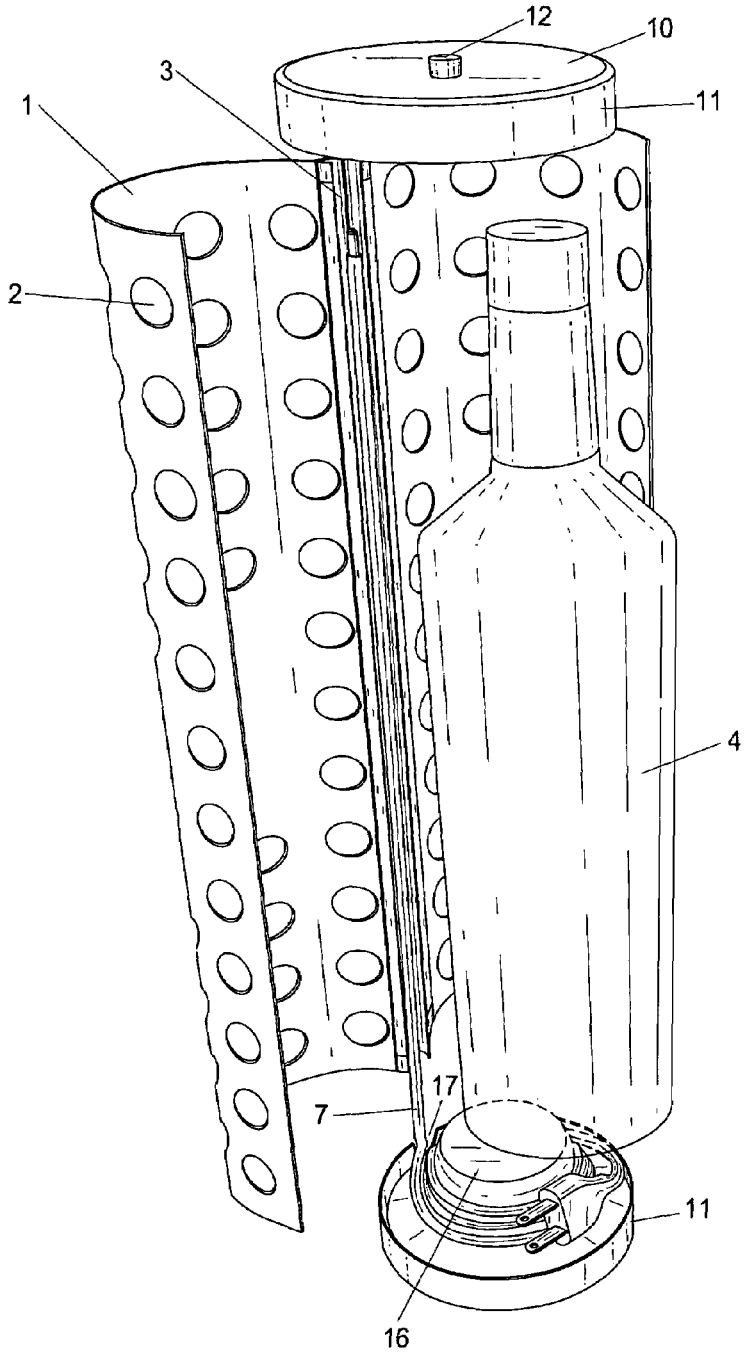
FIG. 1 is a perspective view of the invention opened and containing a bottle.
Figure 2:
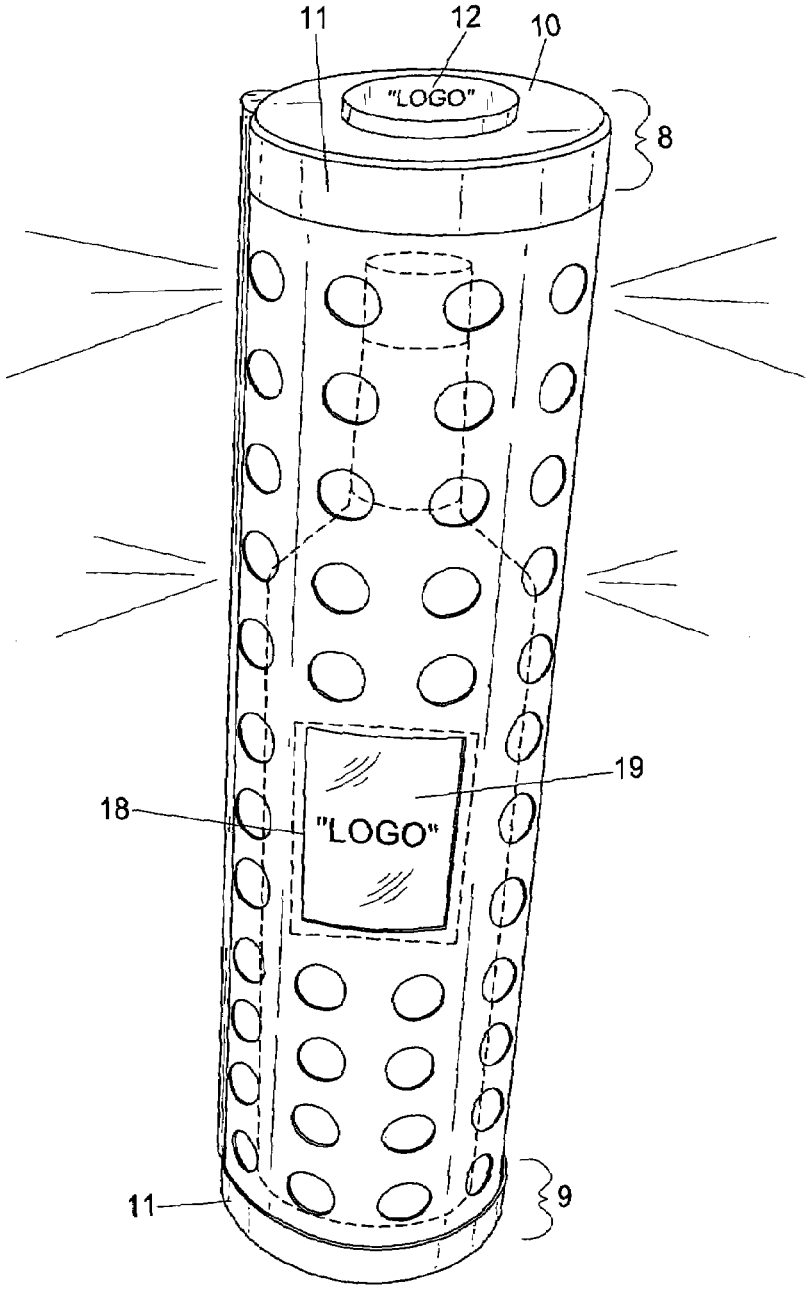
Figure 3:
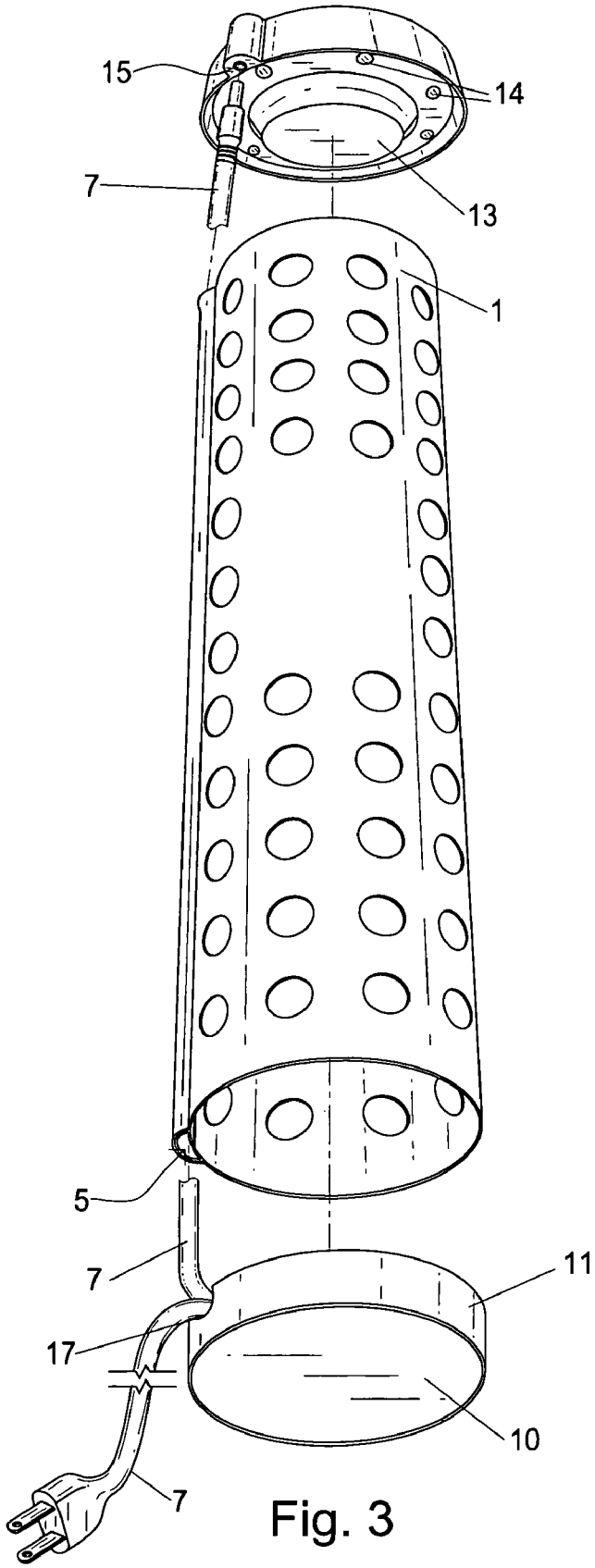
FIG. 3 is an exploded perspective view of the invention without a bottle.
Figure 4:
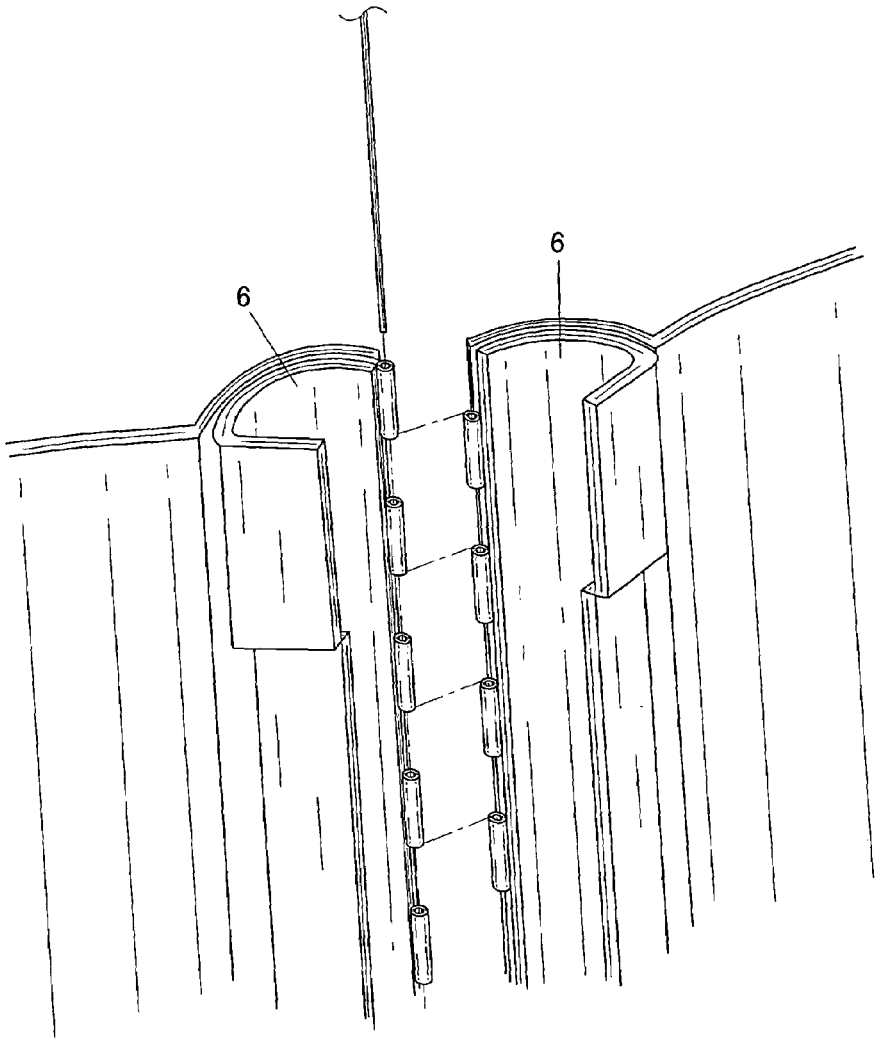
FIG. 4 an exploded perspective view of the hinge and cable housing system of the invention.

The preferred embodiment comprises a cylindrical metal container of appropriate length and diameter to store a liquor bottle. The container comprises a housing (1), which in turn comprises a top, a bottom and an inner circumference. The housing further comprises a plurality of perforations (2) which allow light to project from inside the housing to the outside in a pre-determined pattern. The housing also comprises an outer surface which is capable of receiving a logo or other advertisement and an inner surface. In the preferred embodiment, a portion of the housing does not have perforations to leave a solid area on the outer surface for receiving the advertisement. The advertisement may be on a sticker, applied directly with ink, embossed or etched into the container. In an alternative embodiment, the portion of the outer surface capable of receiving a logo comprises an opening (18) into which a piece of clear or colored material can be inserted. The transparent insert (19) can be printed, embossed or etched with a logo or advertisement. The housing is capable of being opened along its longitudinal axis and it is shaped so it is capable of storing a bottle upon snap-closing. The housing comprises a longitudinal hinge system (3) located directly opposite to the section of the housing which opens to receive a bottle (4), the hinge system being capable of allowing the housing to move from the open to the closed position and vice versa. The housing also comprises a conduit (5) built in or fused to the inner side of the housing, the conduit running parallel to and long the hinge system. The conduit (5) takes the shape of two flanges (6), one on each side of the hinge system's longitudinal line, in the inner side the housing, and forming a semicircular channel when the housing is closed, capable of receiving, housing and securing the cord (7). When the housing is open, the conduit opens as well so the cord can be fit in. The hinge system (3) goes through the housing (1) and the conduit (5). In an alternative embodiment, the housing can be built without a conduit, allowing for simpler design and manufacture.

The invention additionally comprises a top lid (8) and a bottom lid (9). The lids are capable of firmly engaging the top and bottom of the container. Each lid is cylindrical and comprises an inner surface, an outer surface (10) and a lip (11), the lip being slightly smaller than the inner circumference of the container, allowing the lids to firmly engage the container. The outer surface of the bottom lid is flat to create an appropriate base for the assembled invention. In the preferred embodiment, the outer surface of the top lid is embossed with a logo or advertisement. The top lid comprises a circuit board firmly attached to the inside of the lid and wire connections capable of connecting to a source of power via a power cord (7) through a plug and an on/off switch (12) on the exterior side of the lid, and a top hub (13) firmly attached to the bottom of the top lid forming an enclosure which houses the circuit board and the wires, the top hub being appropriately shaped to hold the top of a bottle (4) firmly in place, the top lid housing multiple LED bulbs (14) connected to the power source through the wire connectors capable of illuminating the inside of the bottle container so that the light reflects against the bottle and projects outwardly through the perforations upon turning the exterior switch on, the top lid further comprising a plug (15) capable of receiving a power cord (7). The on/off switch can be any shape, including a company logo or decorative design. The bottom lid (9) comprises an opening (17) capable of allowing the power cord to pass through it. The bottom lid further comprises a bottom hub (16) firmly attached to the bottom side of the bottom lid shaped so it can receive a power cord (7) rolled around the bottom hub and at the same time hold the bottom of a bottle (4) firmly in place.

The invention claimed is:

1. A bottle storage container and lamp combination, comprising:

a. a housing capable of storing a bottle, the housing comprising a top, a bottom, an outer surface, an inner surface and a plurality of perforations in a variety of shapes and sizes, the perforations being capable of allowing light to shine from inside the housing to the outside, the outer surface being capable of receiving a logo or other advertisement, the housing being capable of being opened along its longitudinal axis and being shaped so it is capable of storing a bottle upon snap-closing, the housing further comprising a longitudinal hinge system which opens to receive a bottle, the hinge system being capable of allowing the housing to move from an open to a closed position and vice versa, the housing further comprising a conduit built in or fused to the inner surface of the housing, the conduit running parallel to and along the hinge system, the conduit being capable of adopting the shape of two flanges when the housing is open, one on each side of the hinge system's longitudinal line, and of forming a semicircular channel when the housing is closed, the semicircular channel being capable of receiving, housing and securing a power cord, the hinge system situated through the housing and the conduit;

b. a top lid, the top lid being capable of engaging the top of the housing and comprising an inner side and an outer side, the top lid further comprising a plug capable of receiving the power cord;

c. a circuit board fixedly attached to the inner side of the top lid, the circuit board being capable of connecting to a source of power via the power cord;

d. a power switch extending from the outer side to the inner side of the top lid and engaging the circuit board;

e. a top hub firmly attached to the inner side of the top lid forming an enclosure which houses the circuit board and the wires, the top hub being appropriately shaped to hold a top of a bottle firmly in place;

f. multiple LED bulbs placed in perforations made through the top lid, the LED bulbs capable of being connected to the power source through the wire connectors and being capable of illuminating the inside of the bottle container so that the light reflects against the bottle and projects outwardly through the perforations upon turning the exterior switch on;

g. a bottom lid, the bottom lid being capable of firmly engaging the bottom of the housing and comprising an inner side and a flat outer side, the bottom lid further comprising an opening from the inner side to the outer side, the opening being an appropriate size to allow the power cord to pass through the opening; and h. a bottom hub firmly attached to the inner side of the bottom lid shaped so it can receive the power cord rolled around the bottom hub and at the same time hold a bottom of the bottle firmly in place.

2. A bottle storage container and lamp combination according to claim 1, wherein the housing's outer surface comprises an opening capable of firmly engaging a transparent insert, the insert comprising a surface of identical arc degree as the housing, the insert being capable of receiving a logo or other advertisement, the insert also being capable of snap-fitting into the opening on the housing's outer surface.

3. A bottle storage container and lamp combination according to claim 1, wherein the power switch is shaped as a logo or other advertising symbol.

4. A bottle storage container and lamp combination according to claim 1, wherein the perforations are shaped in such a way that patterns are created when light projects through the perforations.

5. A bottle storage container and lamp combination according to claim 1, wherein the LED bulbs are colored.

6. A bottle storage container and lamp combination according to claim 1, wherein the housing, top lid and bottom lid are constructed from a material selected from a group consisting of metal, wood and plastic.

* * * * *